United States Patent [19]

Morton et al.

[11] 4,038,518

[45] July 26, 1977

[54] DINING TABLE COMBINED WITH FOOD WARMING APPARATUS

[76] Inventors: Richard F. Morton, 200 Buzzard Roost Road; David F. Hale, 508 E. First St., both of Mountain Home, Ark. 72653

[21] Appl. No.: 689,650

[22] Filed: May 24, 1976

[51] Int. Cl.[2] ..... H05B 1/00

[52] U.S. Cl. ..... 219/218; 219/10.47; 219/10.49; 219/385; 219/386

[58] Field of Search ..... 219/218, 385, 386, 10.49, 219/10.47; 312/236; 108/94

[56] References Cited

U.S. PATENT DOCUMENTS

| | | | |
|---|---|---|---|
| 3,740,513 | 6/1973 | Peters, Jr. et al. | 219/10.49 |
| 3,761,668 | 9/1973 | Harnden, Jr. et al. | 219/10.49 |

*Primary Examiner*—C. L. Albritton

*Attorney, Agent, or Firm*—John R. Walker, III

[57] ABSTRACT

A dining table which automatically maintains food at an optimum temperature all the while the food is on the table. Disposed beneath the table top, which permits flux linkage therethrough, is apparatus which generates one or more electromagnetic fields with each of the fields of influence thereof extending upwardly through the table top. Placing a peculiar food vessel within each field of influence causes an electromotive force (EMF) to be generated within conductor windings disposed therein. The food vessel also includes a heating element which is connected to the conductor windings; this heating element is powered by the EMF being generated by the conductor windings. Thus, a nominal amount of heat is developed which keeps the food contained within the food vessel at an optimum temperature.

5 Claims, 7 Drawing Figures

DINING TABLE COMBINED WITH FOOD WARMING APPARATUS

BACKGROUND OF THE INVENTION

1. Field of the Invention

This invention relates to the field of dining tables and is particularly directed towards a dining table having automatically operated food warming apparatus built therein.

2. Description of the Prior Art

It is common knowledge that temperature affects the flavor, aroma, and palatability of many foods, e.g., beefsteak or spaghetti and meatballs and the like. Therefore, a common practice in many eating establishments is to broil beefsteak on a metal platter which is ultimately used as an individual serving platter, i.e., the meat is eaten directly from the metal platter. Accordingly, the metal platter retains a certain amount of heat for a short period of time thus enhancing the palatability of the beefsteak.

Obviously, the metal platter can only retain a certain amount of heat and once it is removed from the source of heat it starts cooling off. Therefore, all too often, the platter has cooled thus allowing the meat to also cool long before the meal is completed.

SUMMARY OF THE INVENTION

The present invention is directed towards overcoming the disadvantages and problems relative to keeping food hot while the food is on the table. The concept of the present invention is to provide an improved dining table which automatically maintains food at the optimum temperature all the while the food is on the table. This is accomplished by structure being disposed beneath the table top, which permits flux linkage therethrough, and which generates one or more electromagnetic fields with each of the fields of influence thereof extending upwardly through the table top. Also included therewith is a peculiar food vessel which is placed on the table top so as to be introduced into one of the fields of influence which causes an electromotive force (EMF) to be generated within conductor windings disposed or embedded therein. The food vessel also includes a heating element which is connected to the conductor windings; this heating element is powered by the EMF being generated by the conductor windings. Thus, a nominal amount of heat is developed which keeps the food contained within the food vessel at an optimum temperature.

The food vessel may include a family style serving dish or an individual serving platter but most emphatically it encompasses a platter upon which an individual might be served beefsteak and the like. It should be mentioned that the present invention is not to be misconstrued as cooking apparatus. Accordingly, any food which requires cooking would have been suitably cooked elsewhere prior to being placed upon the dining table herein disclosed, although the food vessel herein disclosed may be used as a receptacle during the conventional cooking process. Thus, the food vessel would already be hot when placed on the dining table. This is the preferred procedure since the likelihood of the food cooling off prior to the food vessel having a chance to be heated so as to reach the optimum temperature is precluded. Obviously, certain foods, e.g., spaghetti and meatballs and the like, do not lend themselves to being cooked and served from the same food vessel. Therefore, in circumstances such as this, the food vessel preferably is warmed prior to placing this type of foods, which have nonetheless been previously cooked elsewhere, therein.

DESCRIPTION OF THE PREFERRED EMBODIMEMT

Figure 5:
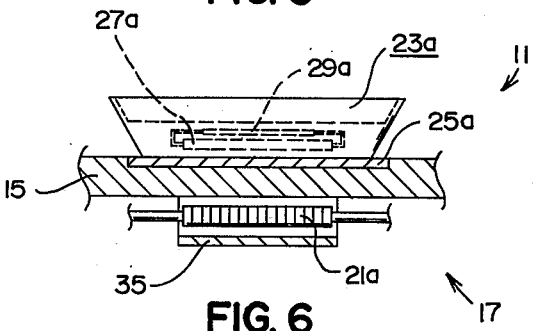
FIG. 5 is a partial sectional view showing the combination of the food vessel being supported upon the dining table of the present invention.

The peculiar combination or concept of the present invention is graphically developed in FIGS. 1 through 5 of the drawing and is clearly depicted as being brought together in FIG. 5 of the drawing and is character referenced therein by the numeral 11. The combination 11 includes a dining table 13 having a horizontally disposed table top 15 constructed from a substance which readily permits flux linkage therethrough, e.g., wood, formica, or any fibrous material and the like. The combination 11 also includes heat producing means, generally indicated at 17, FIG. 5, for constantly maintaining food at an optimum temperature during the complete course of a meal, i.e., the food may selectively be placed in at least one prescribed location on the table top 15 in a manner to be fully disclosed.

Figure 7:
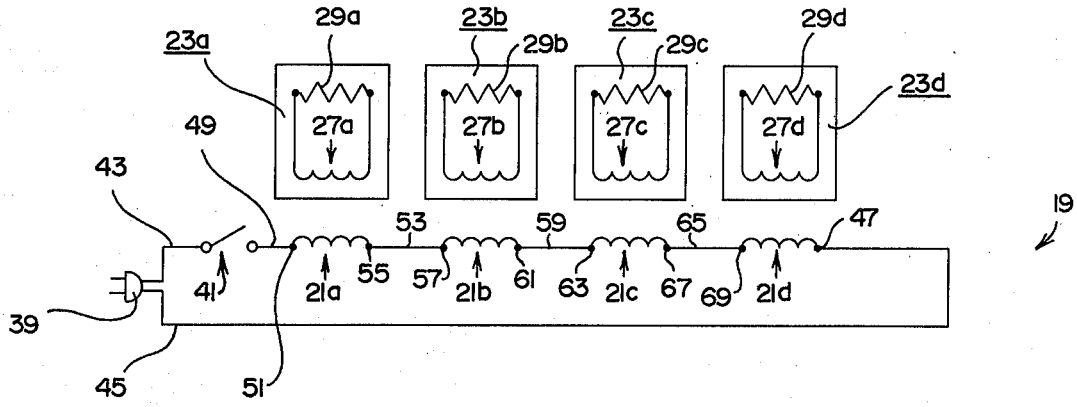
FIG. 7 is a simple schematic of the electrical arrangement of the present invention.

The heat producing means 17 alluded to above includes electric means 19, as best shown in FIG. 7 of the drawing, disposed beneath the table top 15 for generating at least one but preferably a plurality of electromagnetic fields each having a field of influence extending upwardly through the table top 15. Since an electromagnetic field having a field of influence is a well-known phenomenon associated with electromagnetism it is deemed unnecessary to effect graphic depiction thereof in the drawing or to further expound thereon. In other words, it should be sufficient to simply state that the electric means 19 includes a plurality of inductors 21 which are individually designated as 21*a,* 21*b,* 21*c,* etc., i.e., each of the inductors 21*a,* 21*b,* 21*c,* etc., generates an electromagnetic field and te field of influence thereof extends upwardly through the table top 15.

The heat producing means 17 also includes at least one but preferably a plurality of peculiar food vessel means 23 which are individually designated as 23*a,* 23*b,* 23*c,* etc., as diagrammatically depicted in FIG. 7 and with one of the food vessel means 23 being portrayed with vividness in FIGS. 2 through 5 of the drawing. The food vessel means 23 are responsive to the field of influence when placed in the prescribed location, i.e., FIG. 1 clearly depicts a plurality of prescribed locations or indicia means 25 which are individually designated as 25*a,* 25*b,* 25*c,* etc. The indicia means 25 may consist of nothing more than scribe marks affixed to the table top 15 or the indicia means 25 may include platelike structure embedded into the table top 15 as clearly shown in FIG. 5 of the drawing, i.e., the platelike structure also being formed from a substance which readily permits flux linkage therethrough as previously mentioned for the table top 15. In either event, the indicia means 25 is affixed to the table top 15 for readily indentifying each of the prescribed locations thereon which selectively may be utilized for maintaining the food at the optimum temperature, i.e., the prescribed locations or the indicia means readily identify the area having the strongest field of influene for each of the inductors or elecromagnets 21.

The food vessel means 23 includes conductor winding means 27 inductively coupled to the electric means 19 or more specifically to the respective inductor or electromagnet 21 via the field of influence thereof for generating an electromotive force (EMF) therein. Each of the food vessel means 23 also includes heating element means 29 connected to the conductor winding means 27 and being powered by the EMF for developing a nominal amount of heat whereby the food cntained within the food vessel means 23 may be maintained at the optimum temperature during the complete course of the meal.

From FIGS. 2 through 5 of the drawing it may be seen that the food vessel means 23 is in the form of a serving platter with the conductor winding means 27 and the heater element means 29 being embedded therein, i.e., the conductor winding means 27 and heater element means may be enveloped by porcelain 31 or other such material. The food vessel means 23 also includes cladding means 33 for establishing an impervious exterior for the serving platter 23 whereby the conductor winding means 27 and the heating element means 29 are sealably enveloped by the cladding means 33. More specifically, the cladding means 33 preferably consists of unitized stainless steel or the like. Consequently, the food vessel means 23 may be washed and sanitized in any conventional fashion, e.g., using a dishwasher and the like.

Figure 1:
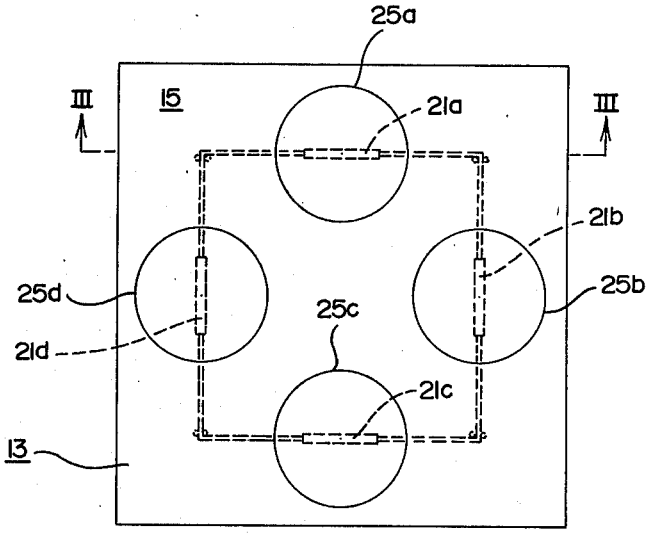
FIG. 1 is a top plan view of the dining table herein disclosed.
Figure 2:
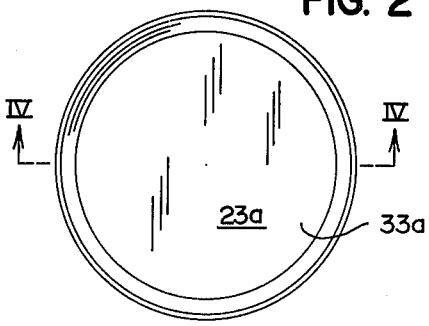
FIG. 2 is a top plan view of the food vessel herein disclosed.
Figure 4:
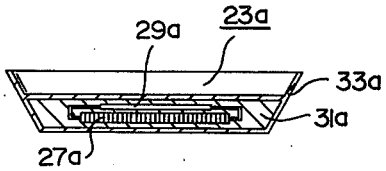
FIG. 4 is a sectional view taken as on the line IV—IV of the food vessel depicted in FIG. 2.
Figure 3:
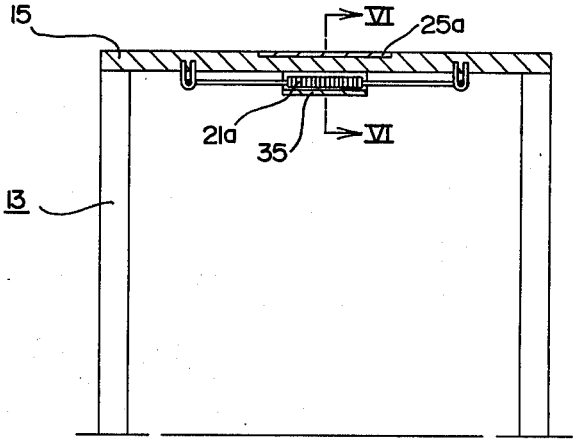
FIG. 3 is a sectional view taken as on the line III—III of the table depicted in FIG. 1.
Figure 6:
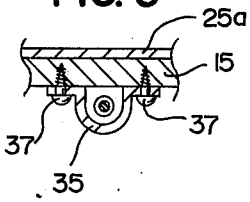
FIG. 6 is a partial sectional view taken as on the line VI—VI of FIG. 3.

From FIGS. 3, 5 and 6 of the drawing it may clearly be seen that the inductors or elecromagnets 21 are enclosed within boxlike structure as at 35 for avoiding inadvertent contact therewith. Further, the boxlike structure 35 is attached to the underneath surface of the table top 15 in any well known maner, e.g., as with a plurality of screws 37 or the like.

Particular attention is now directed toward FIG. 7 of the drawing wherein it may be seen that the electric means 19 includes a conventional male power plug 39 which may conveniently be received in any conventional 115 volt a.c. outlet or the like. Also included therewith is a single pole single throw switch 41 for energizing and de-energizing the electric means 19. It will be appreciatd by those skilled in the art that the inductors or electromagnets 21 may be connected in series as shown in FIG. 7 or optionally in parallel one with the other in a manner well known to those skilled in the art. In either event, the respective food vessel means 23*a,* 23*b,* 23*c,* etc., are inductively coupled to the inductors or electromagnets 21*a,* 21*b,* 21*c,* etc., through their respective fields of influence in a manner well known to those skilled in the art.

The electric means 19 includes a conductor 43 having one end thereof connected to the power plug 39 and the other end thereof connected to the switch 41. Also included is a conductor 45 which has one end thereof connected to the power plug 39 and the other end thereof connected to a terminal 47 for the electromagnet 21*d.* Also included is a conductor 49 having one end thereof connected to the switch 41 and the other end thereof connected to a terminal 51 for the inductor 21*a.* A conductor 53 interconnects a pair of terminals 55, 57; a conductor 59 interconnects a pair of terminals 61, 63; and a conductor 65 interconnects a pair of terminals 67, 69.

Although the invention has been described and illustrated with respect to a preferred embodiment thereof, it is to be understood that it is not to be so limited since changes and modifications may be made therein which are within the full intended scope of the invention.

We claim:

1. The combination with a dining table having a horizontally disposed table top constructed from a substance which readily permits flux linkage therethrough; of heat producing means for constantly maintaining food, which may selectively be placed in at least one prescribed location on said table top, at an optimum temperature during the complete course of a meal; said heat producing means including electric means disposed beneath said table top for generating at least one electromagnetic field each having a field of influence extending upwardly through said table top, and at least one peculiar food vessel means responsive to the field of influence when placed in said prescribed location; said food vessel means including conductor winding means inductively coupled to said electric means via the field of influence for generating an electromotive force therein, and heating element means electrically connected to said conductor winding means and being powered by said electromotive force for developing a nominal amount of heat whereby the food contained within said food vessel means may be maintained at the optimum temperature during the complete course of the meal; said food vessel means being in the form of a serving platter with said conductor winding means and said heater element means being embedded therein, and said food vessel means including cladding means for establishing an impervious exterior for said serving platter whereby said conductor winding means and said heater element means are sealably enveloped by said cladding means.

2. The combination as set forth in claim 1 in which said cladding means consists of stainless steel.

3. In a serving platter, the improvement which comprises conductor winding means selectively responsive to a changing electromagnetic field of influence which may be disposed adjacent thereto whereby an electromotive force is generated within said conductor winding means; and heating element means electrically connected to said conductor winding means and being powered by the electromotive force generated therewith to develop a nominal amount of heat for constantly maintaining items of food, which may be placed on said serving platter, at an optimum temperature; said conductor winding means and said heating element means being embedded within said serving platter.

4. The serving platter as set forth in claim 3 in which is included cladding means for establishing an impervious exterior for said serving platter whereby said conductor winding means and said heating element means are sealably enveloped by said cladding means.

5. The serving platter as set forth in claim 4 in which said cladding means consists of stainless steel.

* * * * *